United States Patent [19]

Torgrimson et al.

[11] Patent Number: 4,875,576

[45] Date of Patent: Oct. 24, 1989

[54] MIXING KIT

[76] Inventors: Lee A. Torgrimson, 9450 Singletree La., Missoula, Mont. 59803; Louis M. Chinske, 2412 Glen Dr., Missoula, Mont. 59801

[21] Appl. No.: 152,898

[22] Filed: Feb. 5, 1988

[51] Int. Cl.[4] ..... B65D 25/08; B65D 77/00

[52] U.S. Cl. ..... 206/219; 200/218

[58] Field of Search ..... 206/218, 219

[56] References Cited

U.S. PATENT DOCUMENTS

| | | | |
|---|---|---|---|
| 1,668,895 | 5/1928 | Fulton . | |
| 2,863,305 | 12/1958 | Shepherd | 206/219 |
| 2,899,110 | 8/1959 | Parker . | |
| 3,285,459 | 11/1966 | Gahm | 206/218 |
| 3,434,589 | 3/1969 | Valtri et al. | 206/218 |
| 3,474,844 | 10/1969 | Lindstrom et al. . | |
| 3,559,416 | 2/1971 | Cornwall | 206/219 |
| 3,587,937 | 6/1971 | Childs . | |
| 4,044,836 | 8/1977 | Martin et al. . | |
| 4,270,589 | 6/1981 | Heinzl . | |
| 4,324,340 | 4/1982 | Belokin, Jr. . | |
| 4,456,134 | 1/1984 | Cooper . | |
| 4,492,313 | 1/1985 | Touzani . | |

FOREIGN PATENT DOCUMENTS

| | | | |
|---|---|---|---|
| 1391904 | 4/1975 | United Kingdom | 206/218 |

OTHER PUBLICATIONS

"Product Level is Always on Top in . . . Bellows Bottles", *Food Engineering,* p. 68 (Apr., 1988).

*Primary Examiner*—Joseph Man-Fu Moy

*Attorney, Agent, or Firm*—Wells, St. John & Roberts

[57] ABSTRACT

A mixing kit for beverages or other mixtures is disclosed. Such a kit includes a predetermined volume of a first substantially non-gaseous mixture component. The first mixture component is adapted for combination with a second liquid mixture component in a predetermined mixture ratio. A volume expandable enclosure is included for retaining the mixture components. The enclosure defines a predetermined condensed enclosure volume sufficient to retain the volume of the first mixture component, and a predetermined expanded enclosure mixture volume. The mixture volume is sufficient to retain both the first and second mixture components in the desired predetermined ratio.

8 Claims, 2 Drawing Sheets

MIXING KIT

TECHNICAL FIELD

This invention relates generally to mixtures comprised of at least two mixture components which are adapted to be combined in a predetermined mixture ratio, and containers for such mixtures.

BACKGROUND OF THE INVENTION

Many beverages, such as fruit juices, are distributed and marketed in a diluted ready-to-consume form. The beverages are typically made from concentrates which are combined with water during production, and shipped in ready-to-use containers. Processing concentrates into diluted form and shipping the large and heavy volume of associated liquid in bulky containers is costly in both processing and distribution.

Many beverage companies also distribute beverage concentrates and leave the addition of water and mixing to the consumer. However, this requires the consumer to provide their own container. Many consumers would prefer purchasing the products in their own prepackaged containers. The consumer doesn't realize the same inconveniences as the beverage suppliers. The consumer typically transports at most a few containers a short distance, as compared to the supplier which must transfer a large number of containers much greater distances, and be concerned with storage and transportation costs.

BRIEF DESCRIPTION OF HTE DRAWINGS

Preferred embodiments of the invention are illustrated in the accompanying drawings, in which.

DETAILED DESCRIPTION OF PREFERRED EMBODIMENTS

The following disclosure of the invention is submitted in compliance with the constitutional purpose of the Patent Laws "to promote the progress of science and useful arts" (Article 1, Section 8).

Figure 1:
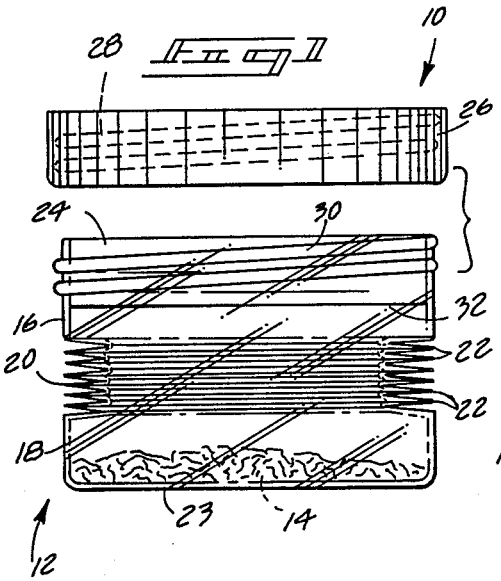
FIG. 1 is a side elevational view of a mixing kit in accordance with the invention.
Figure 2:
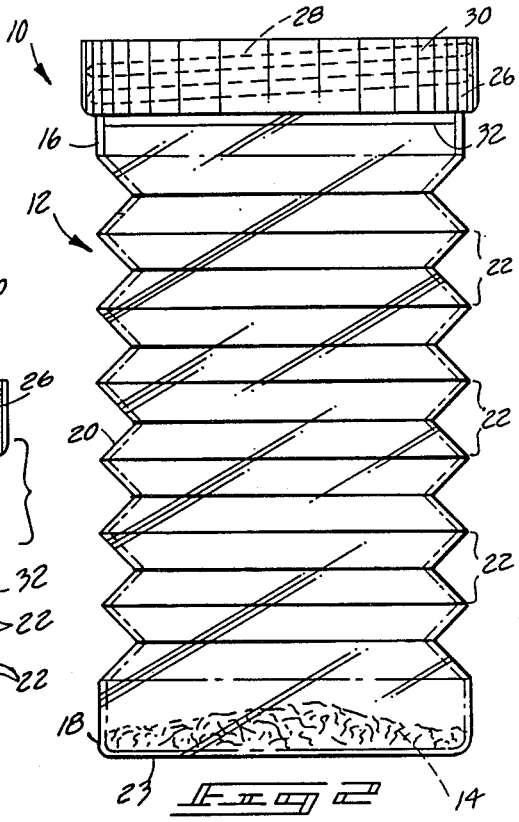
FIG. 2 is a side elevational view of the mixing kit of FIG. 1 shown in an expanded condition.

The invention comprises a self-contained mixing kit primarily developed for the beverage industry. Several embodiments of mixing kits in accordance with the invention are illustrated in the figures. A first embodiment mixing kit is shown by FIGS. 1 and 2, and is indicated generally by reference numeral 10. Mixing kit 10 includes a volume expandable enclosure or container 12 which retains a predetermined volume of a first mixture component 14. First mixture component 14 is substantially non-gaseous and adapted for combination with a second mixture component comprised of liquid in a predetermined mixture ratio. Where mxing kti 10 is configured for beverages, first mixture component 14 will typically be a powder or crystalline solid substance, as shown. Liquid or frozen concentrates would of course also be usable as a first mixture component. The second mixture component would typically comprise water or dilutant which would later be combined by theconsumer with the first mixture component in the predetermined mixture ratio when ready for consumptionor final use.

Container or enclosure 12 is preferably transparent and substantially circular in lateral cross section. It, or course, could be transparent and of altenate cross-sectional configuration. If it preferably constructed to be disposable, although materials of construction could be used that would render the enclosure reusable. Enclosure 12 includes an upper first portion 16 and a lower second portion 18 spaced from upper first portion 16. A third portion 20 is connected to each of second and third portions 16, 18 respectively, and extends therebetween. Third portion 20 is expandable, having a plurality of lateral or accordion-style pleats 22. Second portion 18 is downwardly closed or sealed by an enclosure bottom 23. First portion 16 is upwardly open defining an enclosure opening 24. A lid 26 covers and seals opening 24. It is shown displaced from enclosure 12 in FIG. 1 for clarity, and connected thereto in FIG. 2. Lid 26 includes internal threads 28 which thread to external threads 30 formed about the upper external portion of enclosure first portion 16. Lid 26 preferably hermetically seals opening 24 to provide an air-tight, fluid-tight enclosure.

First, second and third portions 16, 18, and 20 define a predetermined condensed enclosure volume (FIG. 1) sufficient to retain the predetermined volume of first mixture component 14. First, second and third portions 16, 18, and 20 also define a predetermined expanded enxlosure mixture volume (FIG. 2). The expanded mixture volume is sufficient to retain the predetermined volume of first mixture component 14 plus a volume of the second liquid mixture component in the proper predetermined ratio relative to first mixture component 14. Enclosure first portion 16 includes demarcation means int eh form of a fill mark 32 to indicate the level at which liquid should be added to establish the desired predetermined ratio when third portion 20 is expanded. The fill mark 32 would or course not be essential for certain mixtures such as beverages. The expanded container volume approximates the predetermined ratio to produce the desired taste for a beverage.

Enclosure 12 can be constructed of a variety of materials such as plastic, foils, metal, etc. First and second portions 16, 18 are preferably substantially ridig, while third portion 20 will typically be flexible to accommodate the expandable nature of the kit. Enclosure 12 is also preferably constructed to have substantially equal internal cross-sectional dimensions along its entire length. Alternate configurations, such as conical, could of course be usable without departing from the principles and scope fothe invention.

Mixing kit 10 provides the convenience to the beverage manufacturer and consumer for transport and storage in its condensed, concentrated form as shown in FIG. 1. The consumer also derives the benefit of purchasing a beverage capable of consumption from its own container that does not require substantial storage space.

Figure 3:
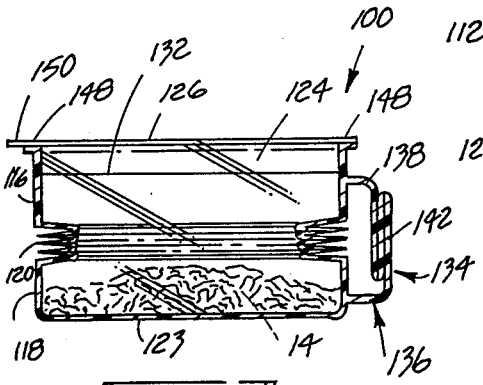
FIG. 3 is a cross-sectional view of an alternat embodiment mixing kit in accordance with the invention.
Figure 4:
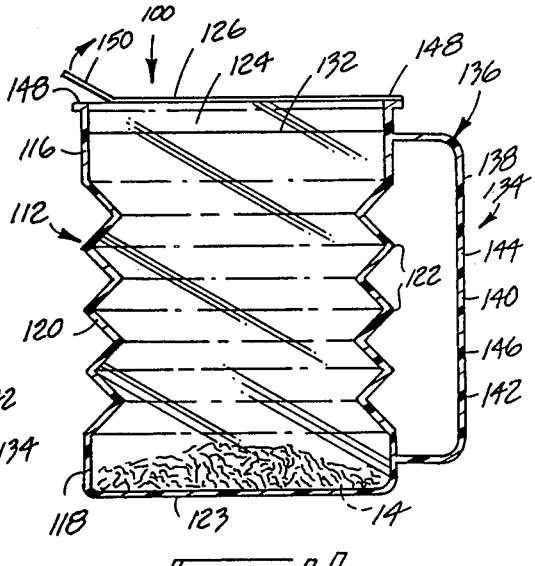
FIG. 4 is a side elevational view of the mixing kit of FIG. 3 shown in an expanded condition.

FIGS. 3 and 4 illustrate an alternate embodiment mixing kit 100 in condensed and expanded conditions. Component parts of mixing kit 100 that are substantially the same as component parts of mixing kit 10 are similarly numbered with 100 series numerals. For example, first portion 16 of mixing kit 10 becomes first portion 116 of mixing kit 100. The same numbering configuration is followed with the description of mixing kits 200 and 300 which follow. Only differences between the kits believed necessary for an understanding of the disclosure are explained below.

Mixing kit 100 primarily differs from kit 10 in the seal for the opening 124 and the provision of an enclosure handle 134. Handle 134 is comprised of a container fourth portion 136 which is divided into three sections 138, 140, 142 which make the fourth portion expandable. Sections 138 and 142 are connected to exteriors of the first and second enclosure portions 116, 118 respectively. Section 140 is connected to and extends between opposite ends of sections 138, 142. Fourth portion 136 is preferably integrally constructed of one piece, with sections 138, 140, 142 being defined by a pair of creases 144, 146. The material of construction is preferably sufficiently flexible to permit folding into the condensed form as shown in FIG. 3, yet, it also preferably assists in maintaining enclosure 112 in an expanded condition when grapsed by a user of the kit.

FIG. 3 illustrates the condensed container volume for mixing kit 100, with fourth portion 136 being folded at each of creases 144, 146. When enclosure 112 is expanded (FIG. 4), fourth portion 136 unfolds at creases 144, 146 to form projection container handle 134. Accordingly, creases 144, 146 and middle section 140 comprise an expandable mid-section enabling the fourth portion to be expanded, as third portion 120 is expanded, to form the expanded container mixture volume. Grasping of middle section 140 and adjacent sections 138, 142 structurally assists in maintaining enclosure 112 in the expanded condition. Although handle 134 is illustrated as being solid throughout, it could also be constructed to be hollow for increasing the mixture capacity of a given length container.

Mixing kit 100 also includes an alternate lid 126 and modified enclosure first portion 116. The uppermost section of first portion 116 comprises a flat, annular rim surface 148. Lid 126 comprises a thin piece of foil which covers opening 124, and is adhered by a suitable adhesive to upper flat rim surface 148. Lid 126 preferably hermetically seals opening 124 to prevent ingress of contaminate or loss of concentrate during shipping. It includes a tab-like projection 150 which radially extends outwardly beyond opening 124 and upper flat rim surface 148. Tab 150 provides an easy way of displacing at least a portion of the lid from the opening (FIG. 4) to break the seal and enable the closure ot be expanded. Were the seal not broken, it would be difficult at best to expand the container due to vacuum pressure that would be created upon attempted expanding of the enclosure.

Figure 5:
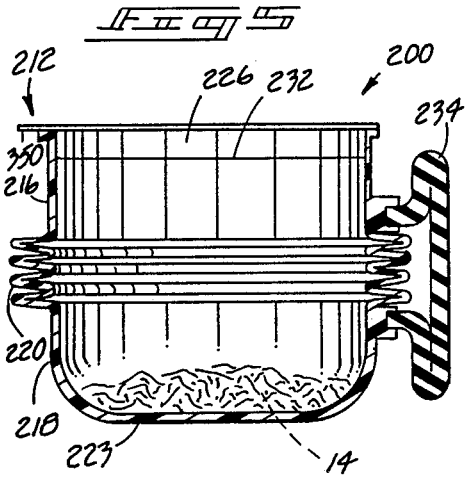
FIG. 5 is a cross-sectional view of yet another embodiment mixing kit in accordance with the invention.
Figure 6:
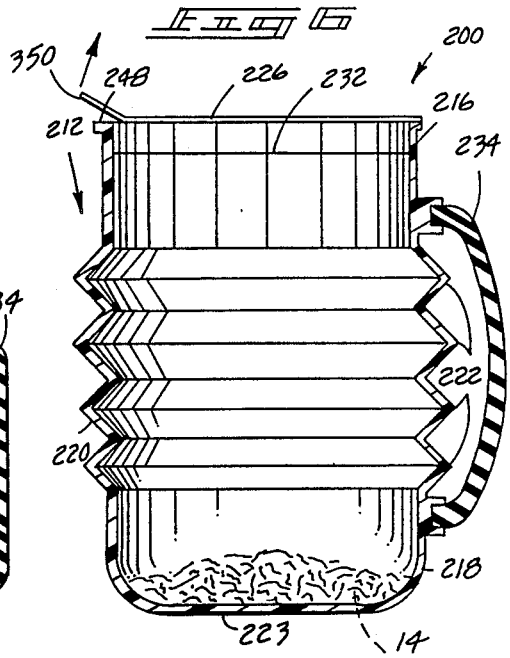
FIG. 6 is a cross-sectional view of the mixing kit of FIG. 5 shown in an expanded condition.

FIGS. 5 and 6 illustrate another alternate embodiment mixing kit 200 in accordance with the invention that is very similar to kit 100 illustrated in FIGS. 3 and 4. Handle 234 of kit 200 is continuous and constructed of a firm but flexible material, such as a rubber material It is substantially soft and flexible along its length to provide the desired collapsibility/expandability, and also adds structural support to support the container in the expanded condition when grasped by a user of the kit.

Figure 7:
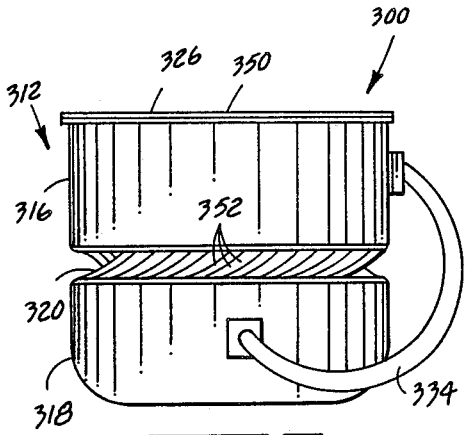
FIG. 7 is a side elevational view of still another embodiment mixing kit in accordance with the invention.
Figure 8:
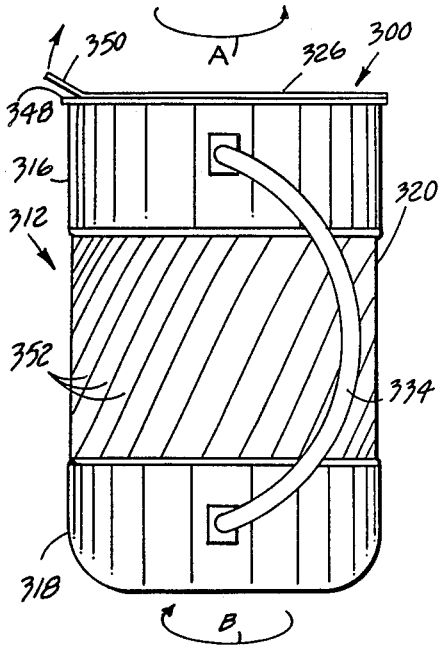
FIG. 8 is a side elevational view of the mixing kit of FIG. 7 shown in an expanded condition.

FIGS. 7 and 8 illustrate still another embodiment mixing kit 300 in accordance with the invention. Mixing kit 300 differs primarily from mixing kits 10, 100 and 200 in its third portion 320. Third portion 320 is expandable, including a plurality of helical creases 352 which spiral or angle between first and second portions 316, 316 respectively. Enclosure 312 is expanded by twisting at least one of first and second portions 316, 318 relative to the other as indicated by arrows A and B in FIG. 8. Handle 334 is illustrated as being of the same configuration as handle 234 of mixing kit 200. The ends of handle 334 are connected to first and second portions 316, 318 such that they longitudinally align when container 312 is in its expanded condition (FIG. 8).

The mixing kit of the invention was primarily developed to assist manufacturers and distributors of beverages by reducing the volume of the container, and yet provide a consumer with a near ready-to-use product in its own container. To use the kit, a consumer would break the lid seal and expand the container to its expanded volume. Water or other dilutant or solvent would be added to the container to the level of the fill mark and stirred to intimately mix the concentrate with the dilutant. The kit would also be advantageous to campers, backpackers, or the like where transport space and weight are of a major significance.

As referred to above, thekit is preferably constructed to be disposable after a single use, but it could be configured for multiple uses by using and ultimately replacing the first mixture component within the enclosure. In such cases, the kit would be constructed to include reusable lids, such as illustrated by FIGS. 1 and 2. Many beverages, such as soft drinks, juices, teas, coffees, hot chocolate, etc. could be packaged and marketed as a kit in accordance with the invention.

Although primarily intended for use with beverages, it will be apparent that the mixing kit has potentially many other uses. Such uses, by way of example and not of limitation, would include:

(a) a fuel kit for two-cycle engines wherein the first mixture component is two-cycle engine oil and the second mixture component is gasoline;
(b) herbicides or pesticides;
(c) breakfast food wherein the first mixture component is a dry cereal and the second mixture component is milk; and
(d) industrial cleaners.

The kit would also of course be usable with mixtures comprised of more than two mixture components.

In compliance with the statute, the invention has been described in language more or less specific as to structural features. It is to be understood, however, that the invention is notlimited to the specific features shown, since the means and construction herein disclosed comprise a preferred form of putting the invention into effect. The invention is, therefore, claimed inany of its forms or modifications within the proper scope of the appended claims, appropriately interpreted in accordance with the doctrine of equivalents.

I claim:

1. A mixing kit comprising:

a predetermined volume of a first mixture component, the first mixture component being substantially non-gaseous and adapted for combination with a second mixture component comprised of liquid in a predetermined mixture ratio: and an enclosure retaining the volume of the first mixture component, the enclosure comprising:

a first portion, the first portion having an enclosure opening;

sealing means for covering the opening;

a second portion spaced from the first portion;

a third portion, the third portion being positioned between and joined to the first and second portions and expandable from a collapsed position to an expanded position;

the first, second and third portions defining a predetermined condensed enclosure volume which retains the volume of the first mixture component; and The first, second and third portions defining a predetermined expanded enclosure mixture volume, the mixture volume being sufficient to retain the volume of the first mixture component plus a volume of the second mixture component in the predetermined ratio relative to the first mixture component; and a fourth portion, the fourth portion being flexible and having one end connected to the exterior of the first portion and a second end connected to the exterior of the second portion, said fourth portion being expandable in response to the expansion of the third portion from a collapsed state to an expanded state in which the fourth portion in the expanded state forms a handle to enable a user to grasp the formed handle and support the mixing kit in the expanded positions to facilitate the mixture of the second mixture component with the first mixture component.

2. The mixing kit of claim 1 wherein the first portion includes demarcation means for indicating a fill volume for the secondmixture component to establish the proper predetermined ratio when the third portion is expanded.

3. The mixing kit of claim 1 wherein the fourth portion includes an expandable section which structurally assists in maintaining the enclosure in an expanded state when the expandable section of the fourth portion is grasped by a user of the kit.

4. The mixing kit of claim 1 wherein the fourth portion includes a soft and flexible middle section adapted to be grasped by the user to support the enclosure in an expanded condition.

5. The mixing kit of claim 1 wherein the sealing means comprises a lid which hermetically seals the opening, the lid having a tab which projects beyond the opening, the tab providing means for displacing at least a portion of the lid from the opening to break the seal and enable the enclosure to be expanded to the expanded mixture volume.

6. The mixing kit of claim 5 wherein the first portion includes an upper flat rim surface against which the lid is adhered and from which the tab projects.

7. The mixing kit of claim 1 wherein, the enclosure formed by the first, second and third portions has substantially equal internal cross-sectional dimensions along its entire longitudinal length; and the third portion includes a plurality of helical creases extending between the first and second portions, expansion of the enclosure resulting from twisting of at least one of the first and second portions relative to the other.

8. The mixing kit of claim 1 wherein, the first portion includes external threads; and the sealing means comprises a lid having internal threads which thread to the external threads of the first portion.

* * * * *